US007635240B2

(12) United States Patent
Gantt, Jr.

(10) Patent No.: US 7,635,240 B2
(45) Date of Patent: Dec. 22, 2009

(54) BEARING PLATE FOR USE IN AN ANCHOR ASSEMBLY AND RELATED METHOD

(76) Inventor: W. Allen Gantt, Jr., 1224 N. Brickyard Rd., Columbia, SC (US) 29223

( * ) Notice: Subject to any disclaimer, the term of this patent is extended or adjusted under 35 U.S.C. 154(b) by 322 days.

(21) Appl. No.: 11/394,017

(22) Filed: Mar. 30, 2006

(65) Prior Publication Data

US 2007/0231081 A1 Oct. 4, 2007

(51) Int. Cl.
*E02D 5/56* (2006.01)

(52) U.S. Cl. ..... 405/252.1; 405/259.1

(58) Field of Classification Search ..... 405/252.1, 405/231, 259.1; 52/157
See application file for complete search history.

(56) References Cited

U.S. PATENT DOCUMENTS

| | | | | |
|---|---|---|---|---|
| 88,891 | A | 4/1869 | McMahen | |
| 137,744 | A | 4/1873 | West | |
| 414,700 | A | 11/1889 | Gray | |
| 816,857 | A * | 4/1906 | George et al. | 52/157 |
| 1,819,949 | A | 8/1931 | Doehring | |
| 1,940,938 | A * | 12/1933 | Chance | 52/157 |
| 2,815,935 | A | 12/1957 | Sedlmayr | |
| 4,290,245 | A | 9/1981 | Pardue, Jr. et al. | |
| 4,334,392 | A | 6/1982 | Dziedzic | |
| 4,549,616 | A | 10/1985 | Rumpp et al. | |
| 5,408,788 | A * | 4/1995 | Hamilton et al. | 52/157 |
| 5,564,353 | A | 10/1996 | Wade et al. | |
| 5,575,122 | A | 11/1996 | Hamilton et al. | |
| 6,182,817 | B1 | 2/2001 | Rinker et al. | |
| 6,394,704 | B1 * | 5/2002 | Saeki et al. | 405/252.1 |
| 7,090,437 | B2 * | 8/2006 | Pinkleton | 405/244 |

* cited by examiner

*Primary Examiner*—John Kreck
(74) *Attorney, Agent, or Firm*—J. Bennett Mullinax, LLC

(57) ABSTRACT

A bearing plate for use in an anchor assembly and associated method are provided. The bearing plate may have a body with a middle portion with a helical configuration about an axis. Leading and trailing portions are also included on either end of the middle portion. An upper leading portion surface may extend an angular distance from 5° to 45° about the axis. The upper leading and middle portion surfaces may extend at different rates in the axial direction per extension about the axis in order to reduce friction on the leading portion during insertion. Additionally or alternatively, the middle portion of the body may be tapered and/or included a rounded outer edge in order to reduce friction during insertion and/or to increase ease of manufacture. A method of putting together an anchor assembly in the field in order to achieve a desired bearing capacity is also disclosed.

13 Claims, 8 Drawing Sheets

BEARING PLATE FOR USE IN AN ANCHOR ASSEMBLY AND RELATED METHOD

FIELD OF THE INVENTION

The present invention relates generally to bearing plates for anchor assemblies that are used to provide support to a structure. More particularly, the present application involves a bearing plate of improved construction that experiences reduced frictional resistance upon insertion. Also, a method of forming an anchor assembly is provided.

BACKGROUND

It is sometimes the case that soil properties at a construction site are not sufficiently stable to allow a structure to be built. Further, currently built structures sometimes become cracked, experience partial collapse, or are otherwise damaged due to unstable soil conditions beneath the structure. Anchor assemblies are used in order to provide structural support to building foundations, retaining walls, oil and gas pipelines, utility towers, and other structures in both new and current construction. Anchor assemblies include a shaft that carries one or more bearing plates that are generally arranged in a helical configuration thereon. Powered rotation is communicated to the shaft to screw the anchor assembly into the ground. Once inserted, the building or other structure may be built or repaired as some or all of its weight is then carried by the anchor assembly.

The bearing capacity of an anchor assembly is a function of the torque placed upon the anchor assembly during insertion and a property of the soil sometimes known as the soil value blow count. Bearing capacity of the anchor assembly can be increased upon increasing the diameter of the bearing plates. In this regard, increasing the diameter of the bearing plates increases the amount of torque necessary to drive the anchor assembly into the ground. Additionally, the bearing plates may be driven deeper into the ground in order to reach soil having a greater density to increase the bearing capacity of the anchor assembly. It is sometimes the case that undesirable friction is created between the bearing plate and the ground when driving the anchor assembly therein. A sharp angle at the tip of the leading edge of the bearing plate may act to generate this friction. Frictional forces act to make it harder to drive the bearing plates into the ground and therefore require that a greater torque be imparted onto the anchor assembly. As the bearing capacity of the anchor assembly is calculated by measuring the required torque, this value may be skewed upon the presence of friction on the bearing plates during installation.

It is also the case that present installation equipment may be capable of generating torque greater than the maximum structural torsional load capacity of the anchor assembly. The bearing plate may possibly hit a rock or other obstruction during insertion that causes one or more components of the anchor assembly to break. In this regard, attempts have been made to strengthen the anchor assembly by heat treating the shaft and/or bearing plates. Additional solutions involve making these components out of a stronger material. Unfortunately, these options are often expensive and time consuming.

A geological survey of the construction site is often conducted in order to ascertain properties of the soil onto which the structure is built. From this data, an anchor assembly having appropriately sized and spaced bearing plates may be selected in order to achieve a desired bearing capacity. Unfortunately, it is sometimes the case that during insertion of the anchor assembly it is discovered that a different anchor assembly is needed. For example, the soil properties from one end of the construction site to the other may vary. The geologist may have tested the soil at a different location than where the anchor assembly is inserted thus resulting in a different soil density at the location of insertion. Additionally, other circumstances arise which prevent the use of an initially chosen anchor assembly. In these instances a different anchor assembly must be used in order to achieve a desired bearing capacity. As bearing plates are generally welded onto shafts, the installer must travel with and keep a variety of differently sized and configured anchor assemblies in order to account for such possibilities. As such, there remains room for variation and improvement within the art.

SUMMARY

Various features and advantages of the invention will be set forth in part in the following description, or may be obvious from the description, or may be learned from practice of the invention.

The present invention provides for a bearing plate for use in an anchor assembly. The bearing plate may be designed in order to include features that reduce the amount of friction experienced by the bearing plate during insertion so as to result in a more accurate calculation of the resulting bearing capacity of the anchor assembly. Additional features of the bearing plate may be provided in order to increase the strength of the bearing plate and ease of manufacture. Further, a method of forming an anchor assembly is provided that allows for the number, spacing, or type of bearing plate to be adjusted in the field so that an anchor assembly with a different bearing capacity can be realized.

In accordance with one exemplary embodiment of the present invention, a bearing plate for use in an anchor assembly is provided that has a body. The body has a middle portion with a helical configuration about an axis. The body has a leading portion and a trailing portion on either end of the middle portion. The leading portion has an upper leading portion surface that extends an angular distance from 5° to 45° about the axis. The upper leading portion surface extends at a constant rate in the axial direction per extension about the axis. The middle portion has an upper middle portion surface. The upper leading portion surface extends at a different rate in the axial direction per extension about the axis than the rate in the axial direction per extension about the axis of the upper middle portion surface that is adjacent to the leading portion that extends the same angular distance about the axis as the upper leading portion surface.

The present invention also includes a bearing plate as immediately discussed in which the upper leading portion surface extends 30° about the axis. Additionally or alternatively, the body of the bearing plate may extend 358° about the axis.

Also provided in another exemplary embodiment is a bearing plate as described above that further includes a hub that is attached to the body. The middle portion of the body is arranged in a helical configuration about the hub. The body is attached to an outer surface of the hub. An additional exemplary embodiment is provided as immediately discussed in which the hub defines at least one aperture through a wall thereof in order to be used to aid in attachment of the hub to a shaft.

The present invention also discloses a bearing plate as described above in which the middle portion of the body has a tapered section that transitions from a larger thickness to a smaller thickness in the outward radial direction from the axis. The middle portion of the body has a uniform section of constant thickness that is disposed from the tapered section in the outward radial direction from the axis. Also provided is an exemplary embodiment as immediately discussed in which the middle portion of the body has a rounded outer edge disposed from the uniform section in the outward radial direction from the axis.

The present invention also provides for a bearing plate for use in an anchor assembly that has a body with a middle portion that is helically configured about an axis. The body has a leading portion and a trailing portion on either end of the middle portion. The middle portion of the body has a tapered section that transitions from a larger thickness to a smaller thickness in the outward radial direction from the axis. The middle portion of the body has a uniform section with a constant thickness disposed from the tapered section in the outward radial direction from the axis.

The present invention also provides in one embodiment a bearing plate as immediately discussed in which the middle portion of the body has a rounded outer edge disposed from the uniform section in the outward radial direction from the axis.

Also provided in yet another embodiment of the present invention is a bearing plate as described above that further includes a hub attached to the body. The middle portion of the body is arranged in a helical configuration about the hub, and the body is attached to an outer surface of the hub.

The present invention also discloses a bearing plate as previously discussed in which the tapered section of the middle portion has an upper tapered section surface that is oriented at an obtuse angle from the axis. The tapered section also includes a lower tapered section surface that is oriented at an obtuse angle from the axis. In a further embodiment of the invention, the orientation of the upper and lower tapered section surfaces are 96.5° from the axis.

The present invention also provides a bearing plate that has a body with a middle portion in a helical configuration about an axis. The body has a leading portion and a trailing portion disposed on either end of the middle portion. The middle portion has an upper middle portion surface disposed opposite from a lower middle portion surface. The middle portion also has a rounded outer edge with an apex that is the location of the middle portion that is at the greatest radial distance from the axis. The apex is located at the axial midpoint between the upper and lower middle portion surfaces adjacent to the outer edge.

In another embodiment of the present invention a bearing plate is provided as immediately discussed in which the middle portion has a tapered section that transitions from a larger to smaller thickness in the outward radial direction from the axis. The middle portion of the body has a uniform section of constant thickness that is disposed from the tapered section in the outward radial direction from the axis. The outer edge is disposed from the uniform section in the outward radial direction from the axis.

The present invention also provides a method of forming and inserting an anchor assembly in the field. The method involves providing a shaft and plurality of bearing plates that have a body attached to a hub. One or more bearing plates are selected for use in the anchor assembly. The selected bearing plates are then attached to the shaft while in the field. The shaft and bearing plates are then inserted into the ground so that the shaft and bearing plates are anchored into the ground.

Also provided in accordance with the present invention is a method as previously discussed in which the attaching step in the field is done by releasably attaching one or more of the bearing plates by bolting the hub of the bearing plates onto the shaft.

A further embodiment exists in a method as previously discussed in which the step of selecting one or more bearing plates is done in the field and is based upon achieving a desired bearing capacity based upon soil conditions in the ground.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
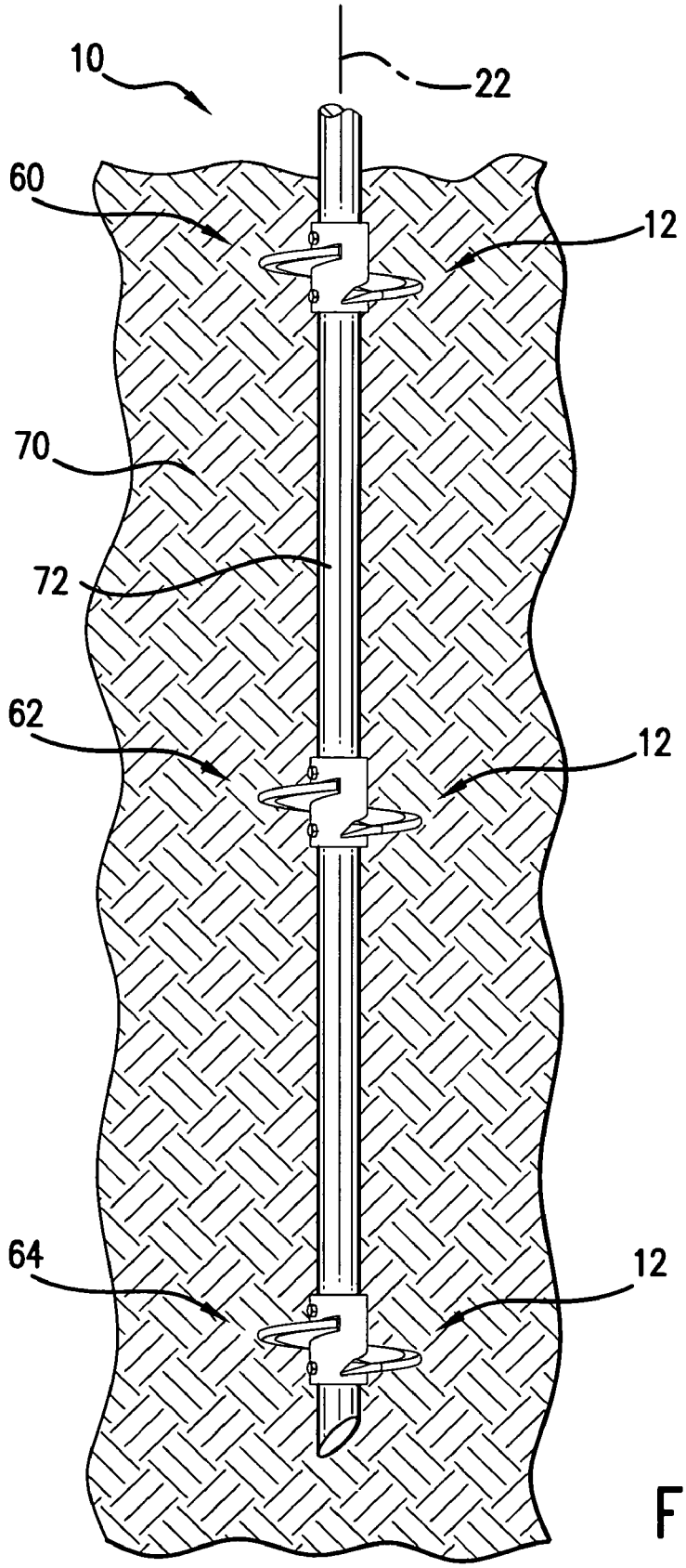
FIG. 1 is a side view of an anchor assembly shown inserted into the ground in accordance with one exemplary embodiment of the present invention.
Figure 2:
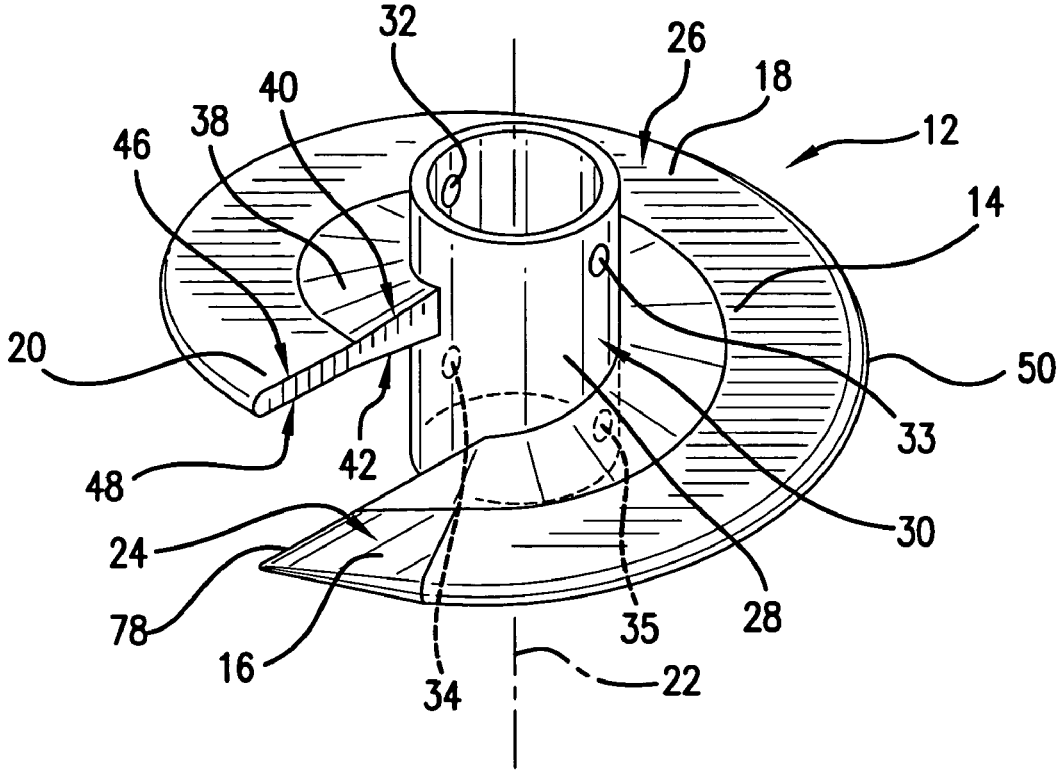
FIG. 2 is a perspective view of a bearing plate in accordance with one exemplary embodiment of the present invention.
Figure 3:
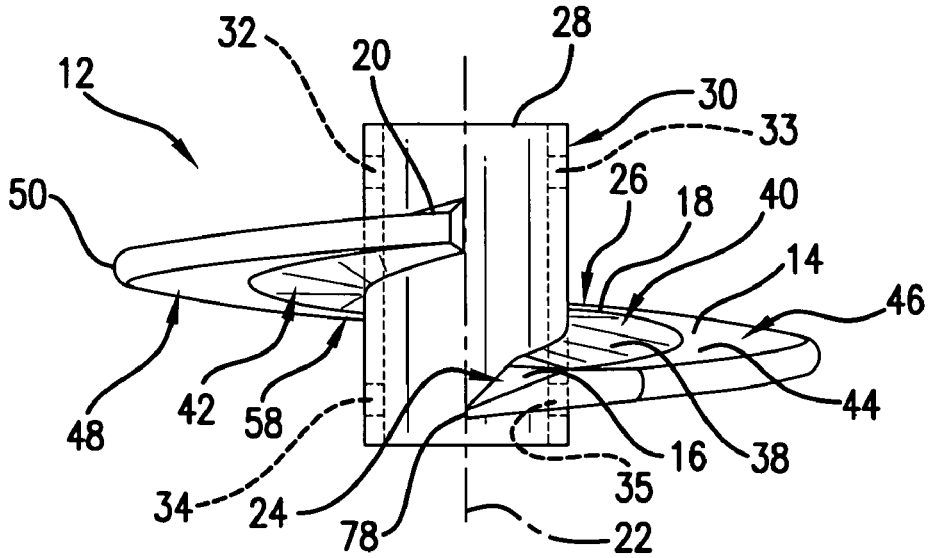
FIG. 3 is a side view of the bearing plate of FIG. 2.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an anchor assembly 10 that is inserted into the ground 70 in order to support the weight of a structure such as a building foundation, utility tower, or pipeline. The anchor assembly 10 may be made of one or more bearing plates 12 that have a leading portion 16 that is configured in such a manner so as to reduce the amount of friction experienced by the anchor assembly 10 upon insertion into the ground. Additional features of the bearing plates 12 are also provided that aid in their manufacture and strength. A method of forming and inserting an anchor assembly 10 is also included that allows one to attach bearing plates 12 to a shaft 72 in the field at the installation site. On-site installation allows the anchor assembly 10 to be constructed to achieve a desired holding capacity should ground 70 conditions be different than originally thought.

FIG. 1 shows an anchor assembly 10 inserted into the ground 70 in accordance with one exemplary embodiment of the present invention. The anchor assembly 10 includes a plurality of bearing plates 12 that are carried by a shaft 72. The shaft 72 is rotated by a power driven device, as is commonly known in the art, in order to screw the shaft 72 and associated bearing plates 12 into the ground 70. Loading from the foundation or other structure is then transferred through the shaft 72 and into bearing plates 12 which in turn provide support to the structure through their engagement with the ground 70.

An exemplary embodiment of a bearing plate 12 is shown in FIGS. 2-5. The bearing plate 12 includes a body 14 that is attached to an outer surface 30 of a hub 28. The body 14 has a middle portion 18 that is helically arranged about an axis 22 on outer surface 30. A leading portion 16 is located on one end of the middle portion 18 while a trailing portion 20 is located on the other end of the middle portion 18. In accordance with various exemplary embodiments, the trailing portion 20 may have the same shape as the middle portion 18 so that these two portions 18 and 20 are essentially one indistinguishable component. As shown in the exemplary embodiment in FIGS. 2-5, the middle portion 18 and the trailing portion 20 have the same shape and are indistinguishable from one another. In these instances, the trailing portion 20 may simply be an end of the body 14. However, in accordance with other exemplary embodiments, the trailing portion 20 may curve inwards in the radial direction towards the outer surface 30 and hence be distinguishable from the middle portion 18 while still being an end of body 14.

Figure 4:
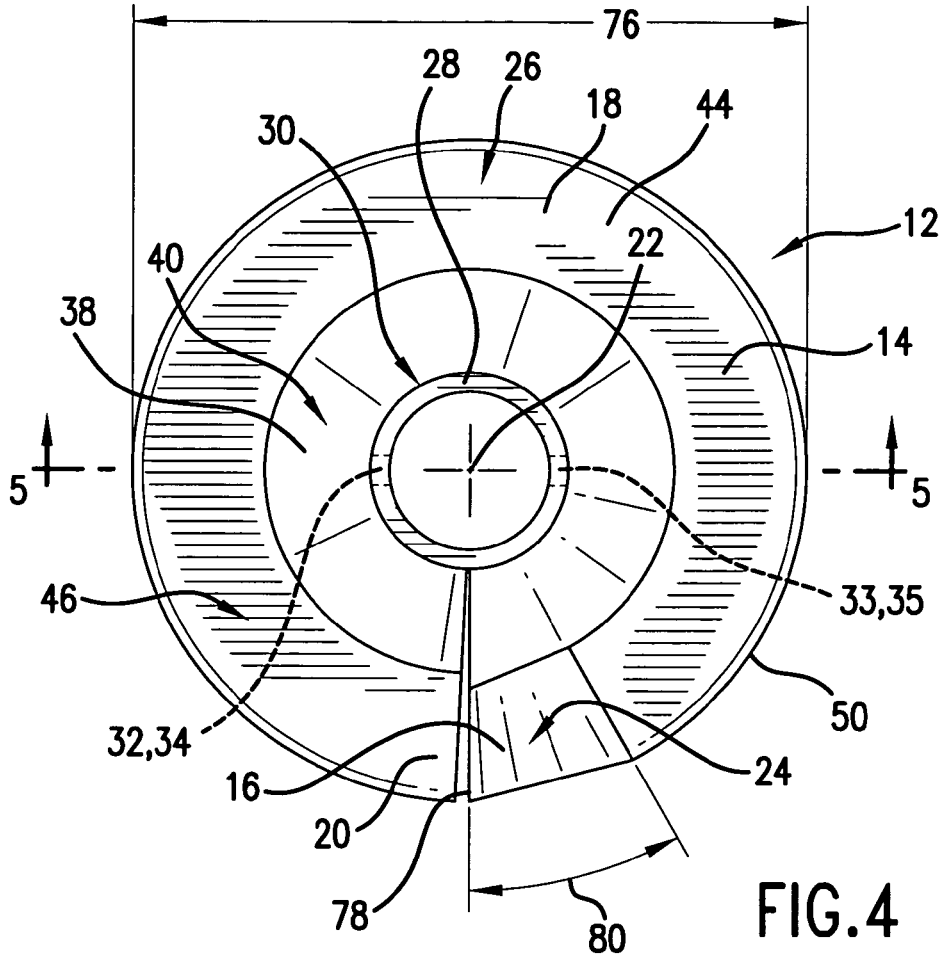
FIG. 4 is a top view of the bearing plate of FIG. 2.

The leading portion 16 is the part of body 14 that advances first into the ground 70. The leading portion 16 converges to a tip 78 in order to aid in advancement of the body 14 through the ground 70. The leading portion 16 has an upper leading portion surface 24. As shown in FIG. 4, the leading portion 16 extends at an angular distance represented by angle 80 about the axis 22. The angle 80 is 30° in the exemplary embodiment shown in FIGS. 2-5. However, it is to be understood that the leading portion 16 may extend at different angular distances in accordance with other exemplary embodiments. For instance, the angle 80 may be from 5° to 45° in different configurations of the bearing plate 12. The bearing plate 12 may be designed in a variety of fashions so as to have a desired pitch. The pitch of bearing plate 12 represents the amount of downward travel into the ground 70 upon one rotation of the bearing plate 12. The bearing plate 12 may have a pitch of three inches in one embodiment. In other embodiments, the bearing plate 12 may have a pitch of two and a half inches, three and a half inches, or four inches. In accordance with various exemplary embodiments, the pitch of bearing plate 12 may be up to six inches.

The leading portion 16 has an upper leading portion surface 24 that is adjacent to an upper middle portion surface 26 of the middle portion 18. The upper leading portion surface 24 is on an opposite side of the middle portion 18 than a lower middle portion surface 58. As can be seen more clearly in FIG. 3, the rate at which the upper leading portion surface 24 extends in the axial direction about axis 22 is different than the rate at which the upper middle portion surface 26 extends in the axial direction about axis 22. The change in rates of extension in the axial direction about axis 22 is present in order to channel the body 14 down into the tip 78 to aid in insertion of the bearing plate 12. The upper leading portion surface 24 extends at an angular distance from 5° to 45° before ending at the upper middle portion surface 26 in order to reduce the amount of friction that is created upon insertion of the bearing plate 12 into the ground 70. Although described as being from 5° to 45°, it is to be understood that angle 80 may be any such angle or range of angles within the given range in other exemplary embodiments. For example, angle 80 is 10°, 20°, 25°, or 35° in other exemplary embodiments. Further, angle 80 may be from 5° to 10°, 10° to 20°, 20° to 40°, 30° to 45°, or from 25° to 45° in other embodiments.

Although the present application describes various surfaces as "upper" and "lower" surfaces, it is to be understood that these terms are for sake of convenience and do not limit the present application to the embodiments disclosed. The upper leading portion surface 24 and the upper middle portion surface 26 may be on the side of the body 14 that faces the direction of insertion in ground 70 or may be on the side of body 14 opposite from the direction of insertion. As such, the upper leading portion surface 24 and the upper middle portion surface 26 may be on the opposite side of the body 14 from that shown in FIGS. 2-5. Also, the side of the body 14 opposite from the upper leading portion surface 24 and the upper middle portion surface 26 may have surfaces that have different rates of extension in the axial direction about axis 22 or may have surfaces that have the same rate of extension in the axial direction about axis 22. Further, the rates of extension in the axial direction about axis 22 for each of the upper leading portion surface 24 and the upper middle portion surface 26 need not be the same across the entire radial length of these surfaces. For example, the inner radial half of the upper leading portion surface 24 may extend at a different rate in the axial direction about axis 22 than the outer radial half of the upper leading portion surface 24 in one embodiment. Additionally, it is to be understood that these surfaces 24 and 26 need not be flat in other embodiments but may have one or more grooves, apertures, and/or projections defined thereon. In certain instances the grooves, apertures, and/or projections may be formed so that the upper leading portion surface 24 still maintains a constant rate of extension in the axial direction about axis 22.

The body 14 may extend any amount about axis 22. In the embodiment shown in FIGS. 2-5, the body 14 extends 358° about axis 22. In other embodiments, the body 14 may extend 360°, 270°, 450°, from 270° to 450°, from 350° to 370°, or up to 450° about axis 22. Additionally, although shown has having a generally constant rate of axial extension about axis 22, it is to be understood that the leading portion 16, middle portion 18, and/or trailing portion 20 of the body 14 may have varying rates of extension.

Referring to FIG. 4, the bearing plate 12 has an outer circumference that extends in the radial direction about axis 22 so as to have a diameter noted by reference number 76. As used herein, the circumference of the body 14 is the boundary thereof when viewing the bearing plate 12 from the top. Although having a generally circular outer circumference, the body 14 of the bearing plate 12 may be shaped in other embodiments so as to have a generally square circumference or a circumference that is generally round with a number of flat portions. It is to be understood that the circumference of the bearing plate 12 may be variously shaped in accordance with different exemplary embodiments and need not be generally circular in shape as shown in FIG. 4.

Figure 5:
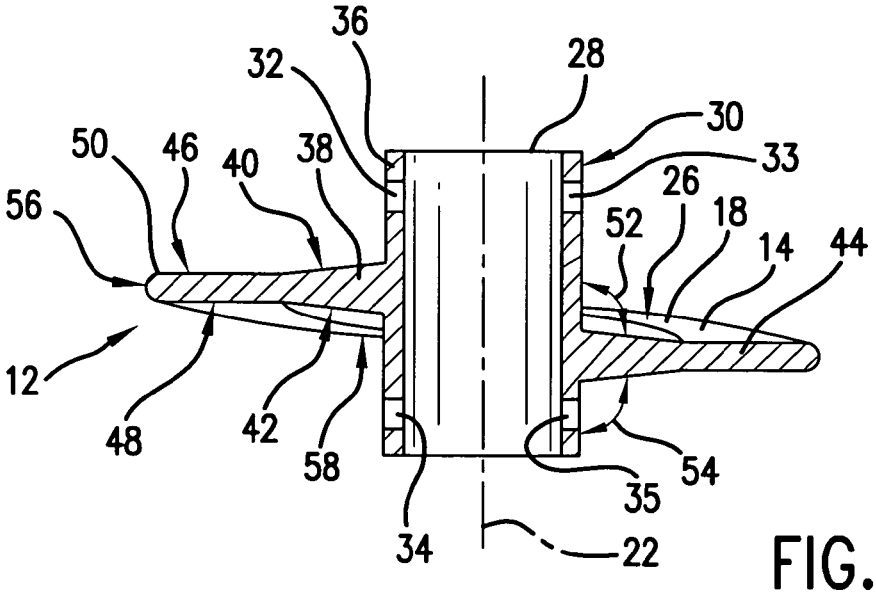
FIG. 5 is a cross-sectional view taken along line 5-5 of FIG. 4.
Figure 6:
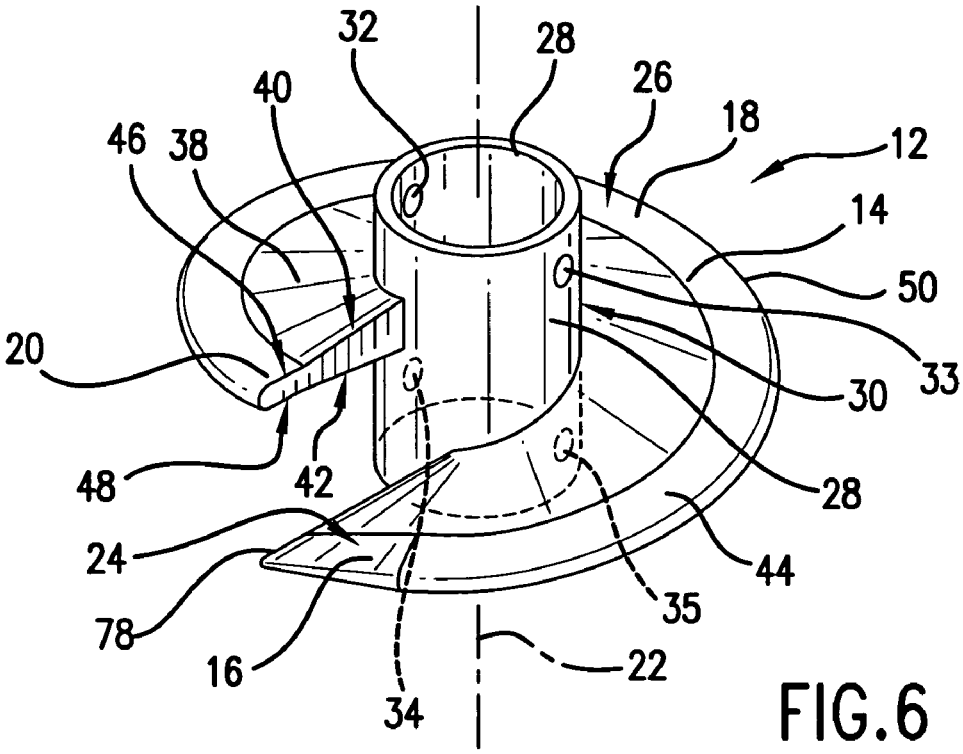
FIG. 6 is a perspective view of a bearing plate in accordance with an alternative exemplary embodiment of the present invention.
Figure 7:
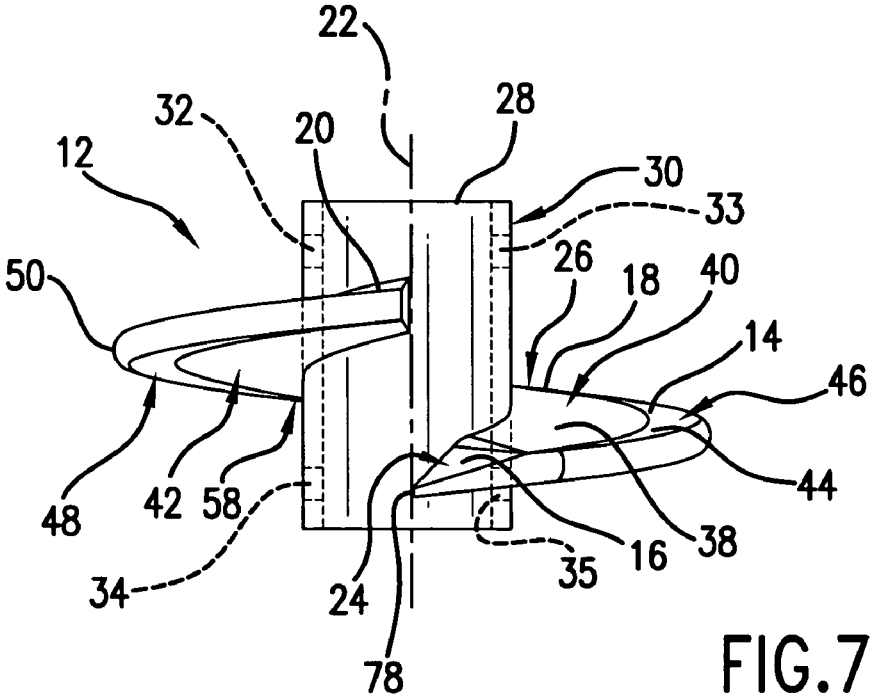
FIG. 7 is a side view of the bearing plate of FIG. 6.
Figure 8:
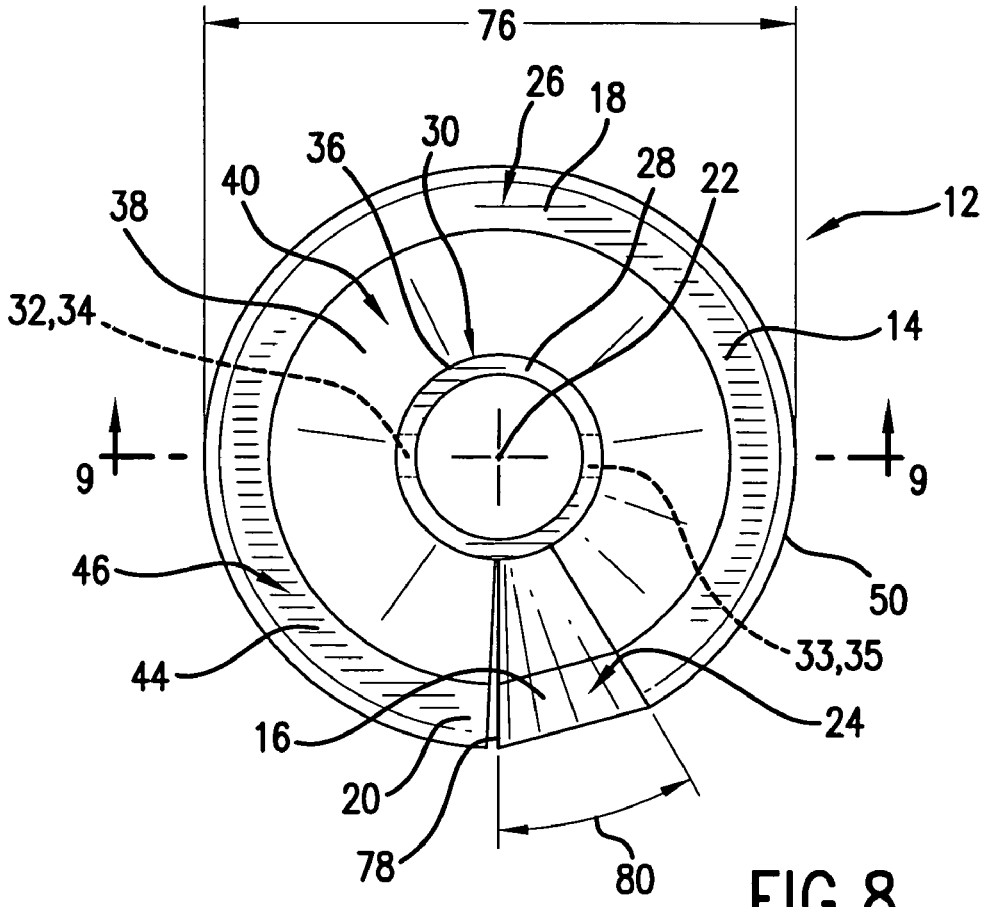
FIG. 8 is a top view of the bearing plate of FIG. 6.

FIG. 5 shows a cross-sectional view of the body 14 and hub 28 taken along line 5-5 of FIG. 4. The body 14 includes a tapered section 38 that extends from a wall 36 of the hub 28. The body 14 also has a uniform section 44 that extends radially outward from the tapered section 38. The tapered section 38 of body 14 provides for a stronger bearing plate 12 which allows for a greater amount of loading on the anchor assembly 10. By having a stronger bearing plate 12 the chances of damaging or completely breaking the bearing plate 12 upon contact with rock or other objects during insertion is reduced. The bearing plate 12 may be formed in a variety of manners. For example, the body 14 may be a separately formed piece that is welded onto the hub 28. Alternatively, the body 14 and hub 28 may be formed though casting in order to be made as one integral piece. The tapered section 38 is a feature of the body 14 that is advantageous in the process of casting the bearing plate 12 as it increases the ease and resultant quality at which the bearing plate 12 may be cast. Further, provision of the tapered section 38 may aid in the insertion of bearing plate 12 into the ground 70 as frictional forces are reduced. Although shown in the exemplary embodiment as having the tapered section 38, it is to be understood that the tapered section 38 is not present in other embodiments.

The tapered section 38 has an upper tapered section surface 40 and a lower tapered section surface 42 that converge towards one another in the outward radial direction. However, it is to be understood that in other exemplary embodiments that the tapered section 38 need not be tapered on both sides. For example, the tapered section 38 may have an upper tapered section surface 40 that tapers in the axial direction radially outward from axis 22 while the opposite side of the tapered section 38 does not taper. Alternatively, the opposite side of the tapered section 38 may be angled in the opposite direction so that it extends in the same axial direction as the upper tapered section surface 40 radially outward from axis 22. In the exemplary embodiment shown, the upper tapered section surface 40 is oriented at an angle 52 that is 96.5°, from the wall 36 that has an outer surface 30 parallel to axis 22. Likewise, the lower tapered section surface is oriented at an angle 54 that is also 96.5° from wall 36. It is to be understood that the angles 52 and 54 may be any obtuse angle in other embodiments. For example, the angles 52 and 54 may be 91°, 93°, 94°, 95°, 98°, 99°, or 100° in other embodiments. The angles 52 and 54 may also be any angle in the range from 91° to 105°, 105° to 120°, or 120° to 150°. Further, the angles 52 and 54 need not be obtuse angles but may be acute angles. The angle 52 or 54 is 90° in instances in which one side of the tapered section 38 is not tapered. The angles 52 and 54 may be the same as one another or may be different in other embodiments of the bearing plate 12.

The uniform section 44 extends radially outward from the tapered section 38 and has an upper uniform section surface 46 and a lower uniform section surface 48 that are oriented at essentially right angles from the wall 36 of hub 28. The uniform section 44 of the middle portion 18 has a constant thickness and defines an outer edge 50. The outer edge 50 is rounded so as to have an apex 56 that represents the most radially outward point of middle portion 18. The outer edge 50 is rounded in a symmetric fashion so that the apex 56 is positioned halfway between the upper uniform section surface 46 and the lower uniform section surface 48. Provision of the rounded outer edge 50 as shown may allow for an increase in the strength of the bearing plate 12 and also aid in creating the bearing plate 12 when casting is employed. Also, the rounded outer edge 50 helps to reduce friction on the bearing plate 12 during insertion into the ground 70 so as to allow for a more accurate measurement of bearing capacity of the anchor assembly 10. It is to be understood, however, that other configurations of the outer edge 50 are possible. For instance, the outer edge 50 need not be rounded but may taper down to a point or may have a flat surface in other embodiments. Further, the outer edge 50 may be rounded and configured so that the apex 56 is located at the meeting point of the outer edge 50 and the upper uniform section surface 46 or the lower uniform section surface 48. Although shown associated with the middle portion 18 in FIG. 5, it is to be understood that the leading portion 16 and/or trailing portion 20 of the body 14 may have the aforementioned cross-sectional shape in other embodiments. Additionally, the cross-sectional shape of the body 14 need not be consistent throughout its length about axis 22 but may be varied one or more times.

Figure 12:
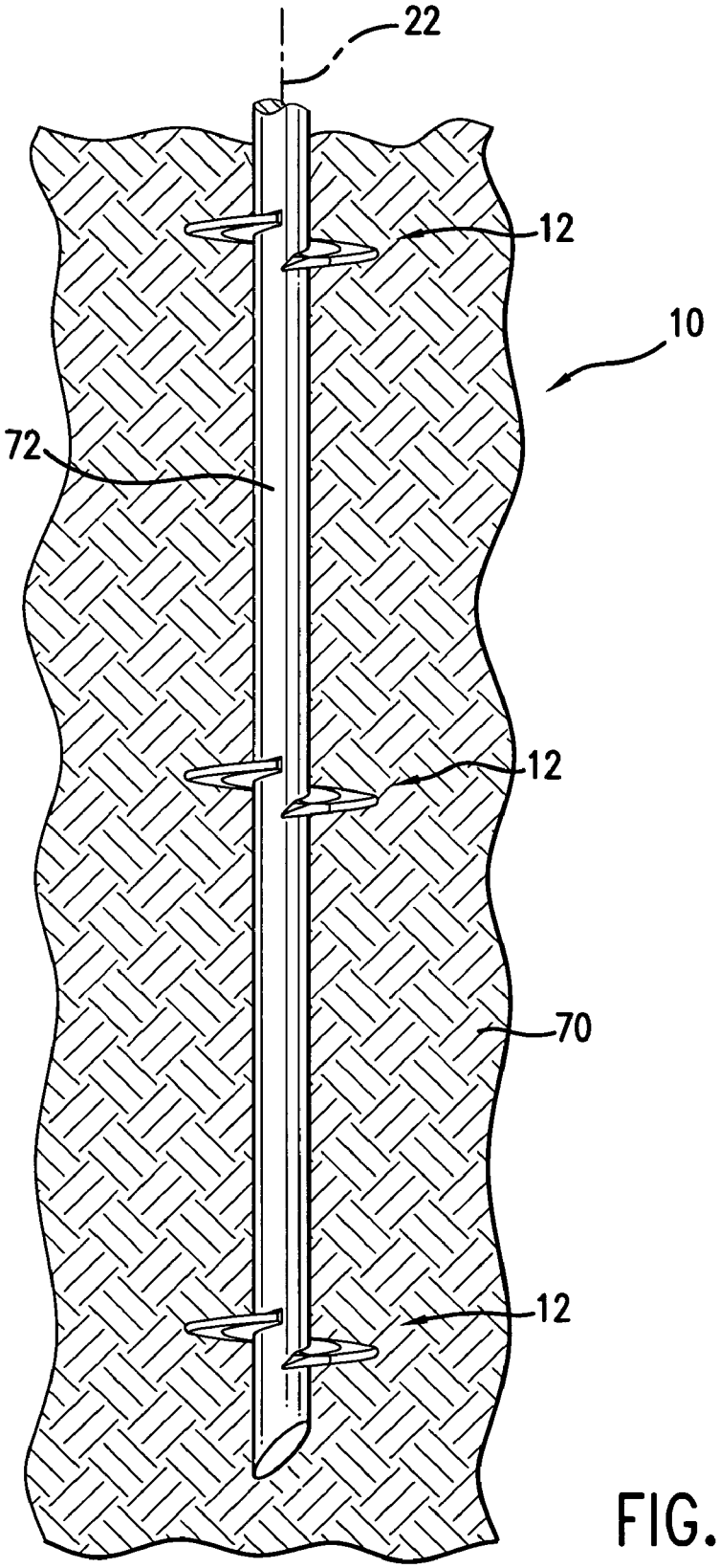
FIG. 12 is a side view of an anchor assembly in accordance with an alternative exemplary embodiment of the present invention in which the bearing plates do not include hubs.

The bearing plate 12 includes a hub 28 that is shaped to fit over a shaft 72 that has a circular cross-section. However, the hub 28 may be shaped in order to fit over a shaft 72 with a square cross-section if desired as both shafts 72 of circular and square cross-sections are commonly employed in anchor technology. In these instances, the bearing plate 12 may be carried by the shaft 72 in any manner commonly known in the art. For example, the hub 28 may be fit over the shaft 72 and welded into place or connected thereto by way of mechanical fasteners. In alternative embodiments, the hub 28 is not present. In these instances, the bearing plate 12 is formed integrally with the shaft 72 or is welded directly onto the shaft 72 or connected thereon by some other form of attachment. FIG. 12 shows an embodiment of the anchor assembly 10 in which the bearing plates 12 do not include a hub 28 and are attached directly onto the shaft 72. The bearing plates 12 may be welded onto the shaft 72 or integrally formed therewith by way of a casting process. Other embodiments exist in which one or more of the bearing plates 12 are attached directly onto the shaft 72 while other bearing plates 12 have a hub 28 and are slid onto and subsequently attached to the shaft 72.

Figure 9:
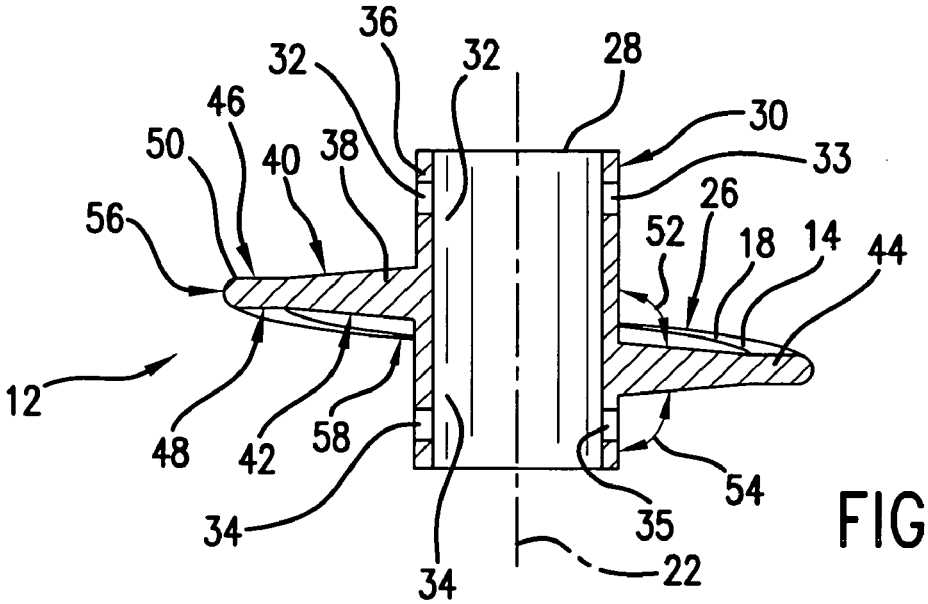
FIG. 9 is a cross-sectional view taken along line 9-9 of FIG. 8.

An alternative configuration of the bearing plate 12 is shown in FIGS. 6-9. The bearing plate 12 is substantially similar to the one shown in FIGS. 2-5 with a few exceptions. First, the bearing plate 12 includes a hub 28 that has a wall 36 that defines a pair of apertures 32 and 34 therethrough. The apertures 32 and 34 penetrate the wall 36 at one location while apertures 33 and 35 are defined on the wall 36 on the other side of axis 22 so as to be in-line with apertures 32 and 34. Aperture 32 is positioned at about the same location in the axial direction as the leading portion 16. Aperture 34 is located on an opposite side of the body 14 from aperture 32 and is located slightly above the body 14 in the axial direction. FIG. 9 is a cross-sectional view taken along line 9-9 of FIG. 8. The tapered section 38 is arranged in a manner similar to that of the embodiment in FIGS. 2-5 in that angles 52 and 54 of 96.5° are present between the wall 36, which is parallel to axis 22, and the upper and lower tapered section surfaces 40 and 42. Additionally, a rounded outer edge 50 similar to the embodiment of FIGS. 2-5 is present at the end of uniform section 44. However, the length of uniform section 44 is shorter in the radial direction in the bearing plate 12 of FIGS. 6-9 than the uniform section 44 shown in FIGS. 2-5.

Figure 10:
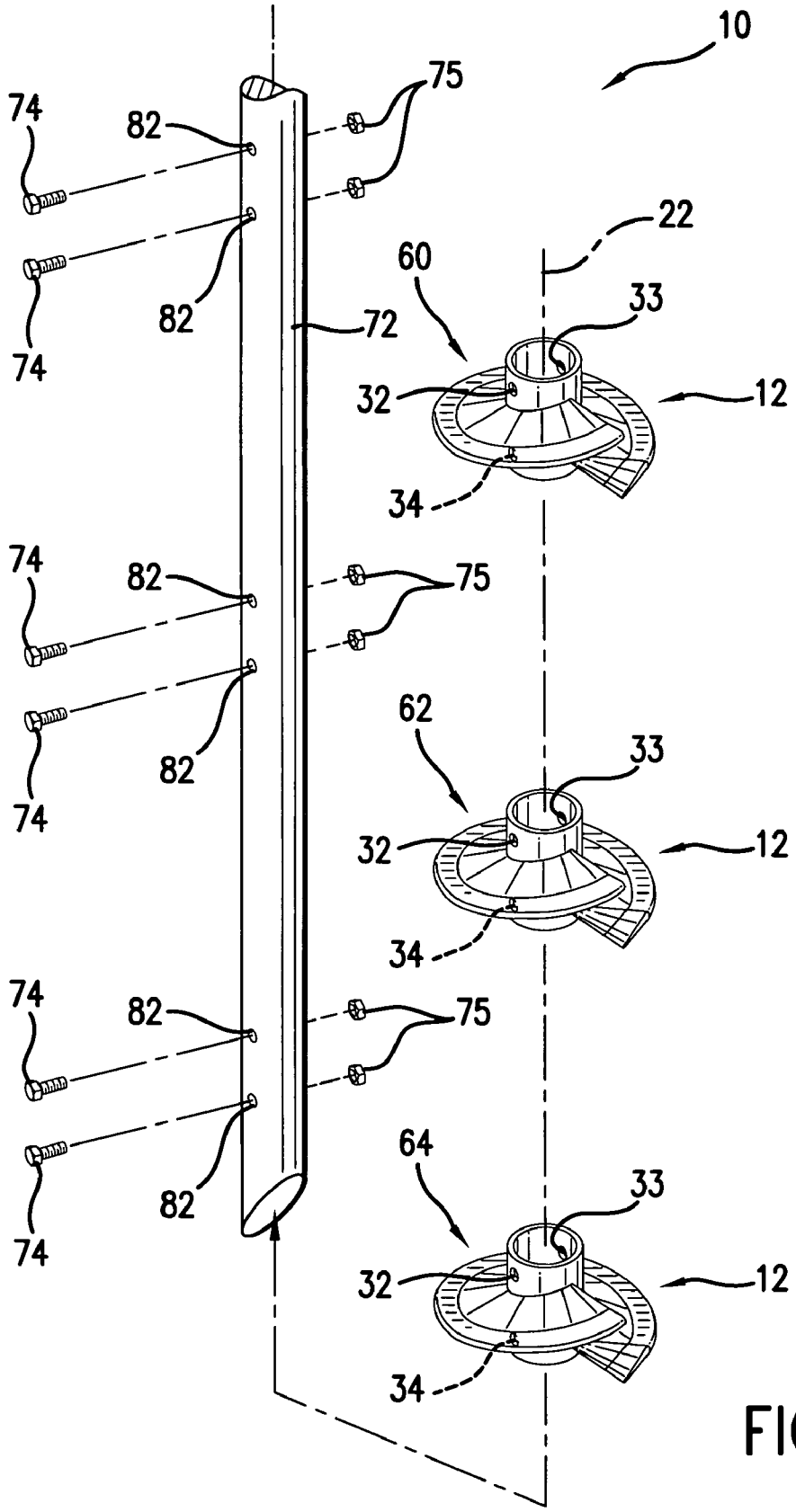
FIG. 10 is an unassembled perspective view of an anchor assembly that incorporates bearing plates configured as those in FIGS. 6-9.

FIG. 10 is an unassembled perspective view of the shaft 72 and three bearing plates 12 configured as those previously described in FIGS. 6-9 and designed by reference numbers 60, 62 and 64. The bearing plates 60, 62 and 64 have the same diameter 76 and are configured in an identical fashion to one another. The shaft 72 has a circular cross-section and has a plurality of apertures 82 along its length. The anchor assembly 10 may be assembled by a user in the field at the location of insertion. It is sometimes the case that a different anchor assembly 10 is needed than previously thought due to a number of factors present in the installation process such as variations in soil conditions from one area of the site to the next. An anchor assembly 10 of a desired construction may be assembled on-site thus eliminating the need of the installer to transport variously configured anchor assemblies 10 and eliminating delays that may occur in having to transport a desired anchor assembly 10 from an off-site location.

Figure 11:
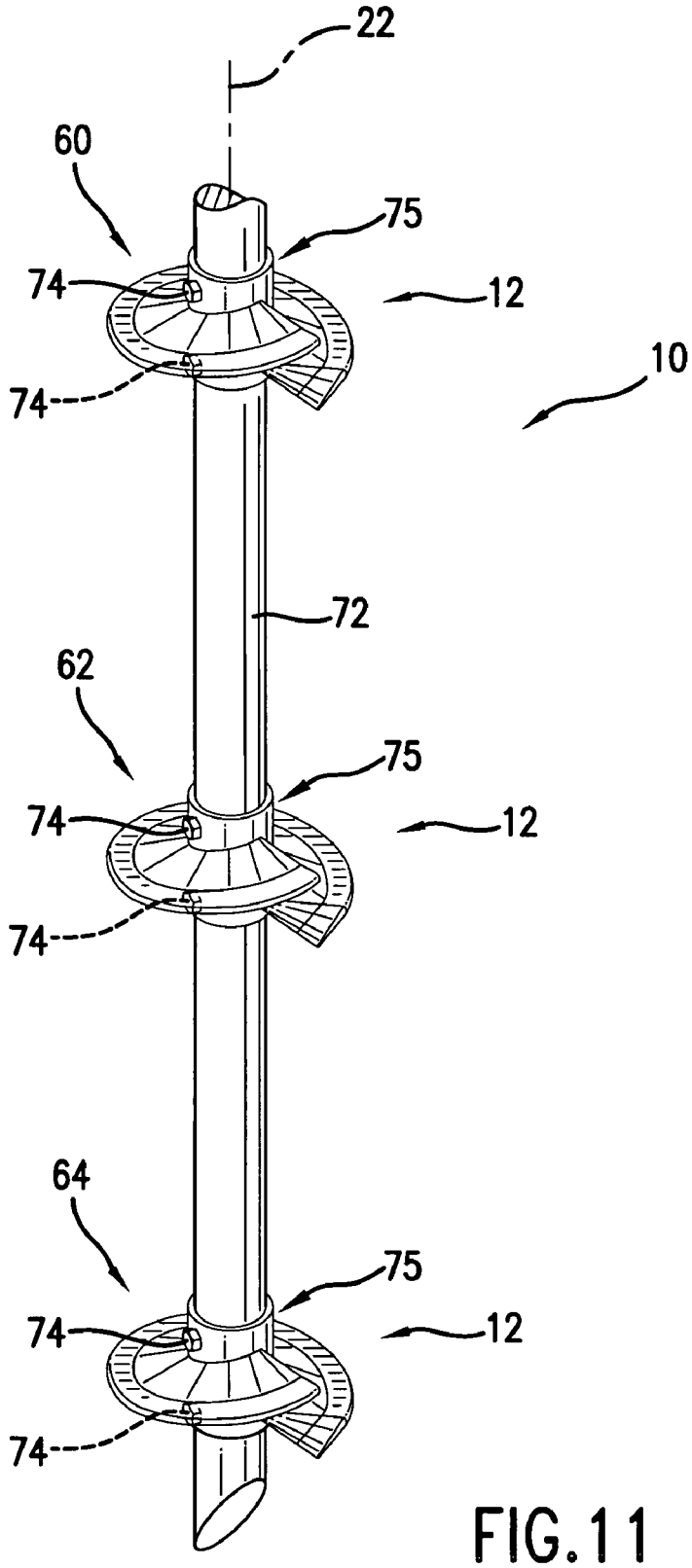
FIG. 11 is an assembled perspective view of the anchor assembly of FIG. 10 in which bolts are used to hold the bearing plates to a shaft.

The installer may slide the hub 28 of bearing plate 60 over shaft 72 and position the bearing plate 60 at a desired location along the length of shaft 72. The remaining bearing plates 62 and 64 may also be placed on shaft 72 in a similar manner. The bearing plates 60, 62 and 64 are secured to shaft 72 though use of bolts 74. FIG. 11 shows the assembled anchor assembly of FIG. 10. In this regard, bolts 74 are inserted though apertures 32, 33, 34 and 35 of bearing plate 60 and are secured with nuts 75 in order to hold the bearing plate 60 onto shaft 72. Again, bearing plates 62 and 64 may be attached in a similar manner. By connecting the bearing plates 60, 62 and 64 though releasable attachment it is possible to readjust or remove the bearing plates 60, 62 and 64 on the fly should a different number, size or configuration be needed.

The bearing plates 60, 62 and 64 are spaced from one another along the length of shaft 72 a distance that is three times their diameter 76. In this regard, bearing plate 60 is located a distance that is three times the diameter 76 of bearing plate 60 from bearing plate 62. Bearing plate 62 is likewise located a distance that is three times the diameter 76 of bearing plate 62 from the next bearing plate 64. Bearing plate 64 is located at an end of shaft 76. The end of shaft 76 at which the bearing plate 64 is disposed at has a tip angled at 45°. In one embodiment, the bearing plates 60, 62 and 64 have a diameter 76 of eight inches and are spaced a distance of twenty four inches. Alternatively, the bearing plates 60, 62 and 64 may have a diameter 76 of ten inches and be spaced a distance of thirty inches. An increase in the diameter 76 generally causes an increase in the amount of torque needed to insert the anchor assembly 10 and in turn causes an increase in the holding capacity.

FIG. 1 shows the assembled anchor assembly 10 with bearing plates 60, 62 and 64 inserted into the ground 70 so as to form an anchor to carry the loading of a structure (not shown). Although shown as using a pair of bolts 74 and nuts 75 to attach each bearing plate 60, 62 and 64 to the shaft 72, it is to be understood that any number of bolts 74 and nuts 75 or other methods of connection may be used as is known in the art. Additionally, the bearing plates 60, 62 and 64 may be permanently attached to shaft 72 in certain embodiments. The spacing of bearing plates 60, 62 and 64 may be done in order to attempt to "track" their paths as they are inserted into the ground 70. In this manner, the soil in ground 70 will have a minimum of disruption thus maximizing the anchoring ability of anchor assembly 10. However, it is to be understood that in other embodiments the bearing plates 60, 62 and 64 may be spaced from one another at a variety of lengths that may lead to a larger disruption of the ground 70 upon insertion.

The anchor assembly 10 can be made in a variety of manners so as to have any number, size or configuration of bearing plates 12. For example, bearing plate 60 may have a larger diameter 76 than bearing plates 62 and 64 in one embodiment. Additionally, the pitch of bearing plate 60 may be different than that of bearing plates 62 and 64 in a different embodiment. Further, the spacing between bearing plates 60 and 64 may be three times the diameter of bearing plate 64 while the spacing between bearing plates 64 and 66 is only twice the diameter of bearing plate 64. Additionally, a greater of fewer number of bearing plates 12 may be included in the anchor assembly 10. For instance, the anchor assembly 10 may have one bearing plate 12 or may have six bearing plates 12 in other embodiments. The anchor assembly 10 may be arranged so that no amount of soil is removed from the ground 70 upon insertion. Alternatively, the anchor assembly 10 can be made so that some amount of soil is pulled up and removed from the ground 70 when the anchor assembly 10 is inserted.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A bearing plate for use in an anchor assembly, comprising:

a body having a middle portion with a helical configuration about an axis, said body having a leading portion and a trailing portion on either end of said middle portion;

wherein said middle portion of said body has a tapered section that transitions from a larger thickness to a smaller thickness in the outward radial direction from said axis, wherein said tapered section has an upper tapered section surface that extends at a constant angle with respect to said axis in the outward radial direction away from said axis, and wherein said middle portion of said body has a uniform section disposed from said tapered section in the outward radial direction from said axis, and wherein said uniform section has a constant thickness.

2. The bearing plate as in claim 1, wherein said middle portion of said body has an outer edge disposed from said uniform section in the outward radial direction from said axis, and wherein said outer edge is rounded.

3. The bearing plate as in claim 1, further comprising a hub attached to said body, wherein said middle portion of said body is arranged in a helical configuration about said hub, and wherein said body is attached to an outer surface of said hub.

4. The bearing plate as in claim 1, wherein said upper tapered section surface is oriented at an obtuse angle from said axis, and wherein said tapered section of said middle portion has a lower tapered section surface that is oriented at an obtuse angle from said axis.

5. The bearing plate as in claim 4, wherein said upper tapered section surface is oriented at an angle of 96.5° from said axis, and wherein said lower tapered section surface is oriented at an angle of 96.5° from said axis.

6. The bearing plate as in claim 1, wherein said leading portion has an upper leading portion surface that extends an angular distance from 5° to 45° about said axis, and wherein said upper leading portion surface extends at a constant rate in the axial direction per extension about said axis; and wherein said middle portion has an upper middle portion surface made from said upper tapered section surface and an upper uniform section surface, and wherein said upper leading portion surface extends at a different rate in the axial direction per extension about said axis than the rate in the axial direction per extension about said axis of said upper middle portion surface adjacent to said leading portion that extends the same angular distance as said upper leading portion surface about said axis, wherein said upper tapered section surface has a larger length in the radial direction than said upper uniform section surface.

7. A bearing plate for use in an anchor assembly, comprising:

a body having a middle portion with a helical configuration about an axis, said body having a leading portion and a trailing portion on either end of said middle portion;

wherein said middle portion has an upper middle portion surface disposed opposite from a lower middle portion surface, and wherein said middle portion has a rounded outer edge with an apex that is the location of said middle portion that is at the greatest radial distance from said axis, and wherein said apex is located at the axial midpoint between said upper middle portion surface and said lower middle portion surface adjacent to said outer edge, wherein said middle portion of said body has a tapered section that transitions from a larger thickness to a smaller thickness in the outward radial direction from said axis, wherein said tapered section has an upper tapered section surface that extends at a constant angle with respect to said axis in the outward radial direction away from said axis across the entire upper tapered section surface, and wherein said middle portion of said body has a uniform section disposed from said tapered section in the outward radial direction from said axis, and wherein said uniform section has a constant thickness, and wherein said outer edge is disposed from said uniform section in the outward radial direction from said axis.

8. The bearing plate as in claim 7, further comprising a hub attached to said body, wherein said middle portion of said body is arranged in a helical configuration about said hub, and wherein said body is attached to an outer surface of said hub.

9. The bearing plate as in claim 8, wherein said hub defines at least one aperture through a wall thereof for use in attaching said hub to a shaft.

10. The bearing plate as in claim 1 wherein said leading portion has an upper leading portion surface that extends an angular distance from 5° to 45° about said axis.

11. The bearing plate as in claim 1, wherein said upper leading portion surface extends 30° about said axis.

12. The bearing plate as in claim 1, wherein said upper leading portion surface extends across the entire radial length of said leading portion.

13. The bearing plate as in claim 1 wherein a hub is attached to said body, wherein said middle portion of said body is arranged in a helical configuration about said hub, and wherein said body is attached to an outer surface of said hub, and wherein said hub extends beyond both said leading portion and said trailing portion in the axial direction.

* * * * *